United States Patent [19]

Konishi

[11] 4,335,691

[45] Jun. 22, 1982

[54] ALTITUDE COMPENSATION IGNITION SYSTEM

[75] Inventor: Hideki Konishi, Tokyo, Japan

[73] Assignee: Nissan Motor Co., Ltd., Yokohama, Japan

[21] Appl. No.: 120,308

[22] Filed: Feb. 11, 1980

[30] Foreign Application Priority Data

Feb. 13, 1979 [JP] Japan ..... 54/15904[U]

[51] Int. Cl.[3] ..... F02P 5/04

[52] U.S. Cl. ..... 123/410; 123/412

[58] Field of Search ..... 123/410, 412; 92/44, 92/42

[56] References Cited

U.S. PATENT DOCUMENTS

| | | | |
|---|---|---|---|
| 1,712,882 | 5/1929 | Gleason et al. | 92/44 X |
| 2,646,781 | 7/1953 | Doyen | 123/410 |
| 3,561,411 | 2/1971 | Vasilesco et al. | 123/410 |
| 4,175,520 | 11/1979 | Russell et al. | 123/412 |

*Primary Examiner*—Tony M. Argenbright

[57] ABSTRACT

An altitude compensation ignition system for compensating ignition timing of an internal combustion engine depending upon variations in altitude or atmospheric pressure comprises pressure sensitive compensation means consisting of a bellows whose ends are fixed to a distributor and a vacuum advance device and adapted to be elongated and shortened in response to variations in atmospheric pressure. When the atmospheric pressure is lowered, the bellows is elongated to move a contact point relative to a rotor of the distributor, thereby advancing the ignition timing.

1 Claim, 7 Drawing Figures

ALTITUDE COMPENSATION IGNITION SYSTEM

BACKGROUND OF THE INVENTION

1. Field of the Invention

The present invention relates to an altitude compensation ignition system for compensating ignition timing of an internal combustion engine having an ignition system, for example, a gasoline engine for an automobile, depending upon variations in altitude or atmospheric pressure.

2. Description of the Prior Art

A conventional internal combustion engine has an ignition timing advance device responsive to revolutions or loads of the engine but in general does not have means for compensating the ignition timing depending upon a higher altitude or a lower atmospheric pressure. Therefore, the engine, used in highlands, considerably reduces its output and increases its fuel consumption resulting in emission of much higher pollutant exhaust gases.

In other words, there have been the centrifugal advance device for compensating the ignition timing responsive to engine revolutions and the vacuum advance device for compensating the timing depending upon engine loads for controlling the ignition timing of an internal combustion engine. In effect, however, these advance devices only meet ignition timing characteristics required at low altitudes.

When an engine is used at higher altitudes or at lower atmospheric pressures, air charging efficiency R during suction strokes decreases owing to the reduced air density and required ignition timing M should therefore be advanced as shown in FIG. 1. More severe knocking occurs with higher altitudes as shown in FIG. 2 wherein a knocking zone in a lower altitude place is shown in Nl and a knocking zone at an altitude of 2,000 meters is in Nh. In recent years, as low octane fuels containing little additions have been widely used to take measures to reduce polluting exhaust gases, knocking zones Nl and Nh are often positioned lower than curves of required (optimum) ignition timing as shown in FIG. 2, so that the ignition timing is frequently unavoidably set at an insufficient advance although the output and fuel consumption of an engine are under worse conditions.

In FIG. 2, Ml indicates the optimum ignition timing at a low altitude, Dl the design ignition timings at a low altitude, Mh the optimum ignition timings at an altitude of 2,000 meters and Dh the design ignition timings at the altitude of 2,000 meters.

SUMMARY OF THE INVENTION

The present invention resides in a discovery that the higher the altitude, the lower the air charging efficiency becomes and severe knocking occurs as shown in a knocking zone N in FIG. 3, and therefore even if the ignition timing is advanced as the altitude increases as shown in FIG. 4, no knocking can occur any longer and the fuel consumption at higher altitudes can be reduced and the worse conditions of output and exhaust gases are minimal as shown in FIG. 5 where L, H and H' indicate fuel consumptions at lower altitudes, at the altitude of 2,000 meters and the same altitude using the altitude compensation ignition system according to the invention, respectively.

It is an object of the invention to provide an altitude compensation ignition system for an internal combustion engine which comprises pressure sensitive compensation means for advancing ignition timing depending upon reductions in atmospheric pressure, thereby improving the combustion in the engine by bringing the ignition timing to a required timing as near as possible depending upon not only the variation in atmospheric pressure at lower altitude but also the variation in the pressure owing to an increase in altitude.

In order that the invention may be more clearly understood, preferred embodiments will be described, by way of example, with reference to the accompanying drawings.

DETAILED DESCRIPTION OF THE PREFERRED EMBODIMENT

Figure 1:
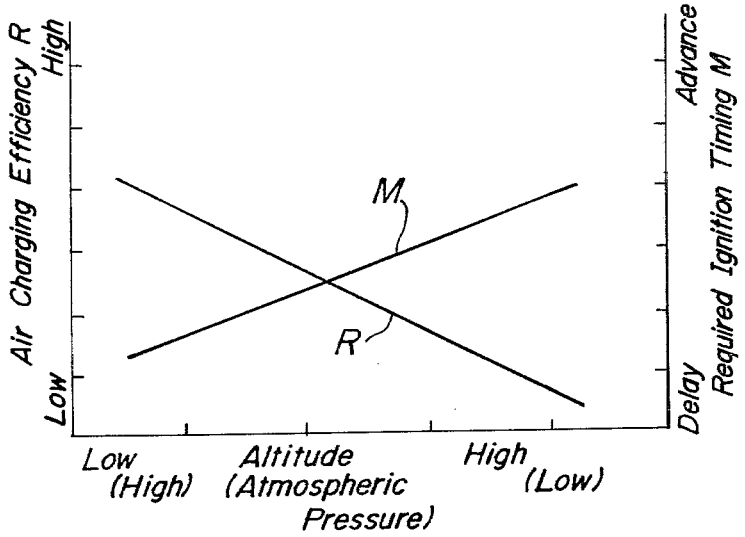
FIG. 1 is a graph showing characteristic lines of air charging efficiency and required ignition timing with respect to the altitude (atmospheric pressure) as mentioned above.
Figure 2:
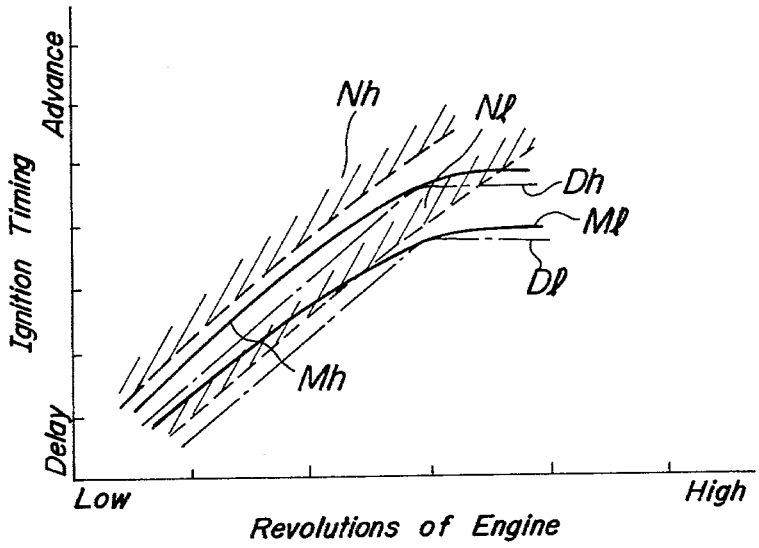
FIG. 2 is a graph illustrating characteristic curves of various ignition timings and knocking zones with revolutions of an engine as mentioned above.
Figure 3:
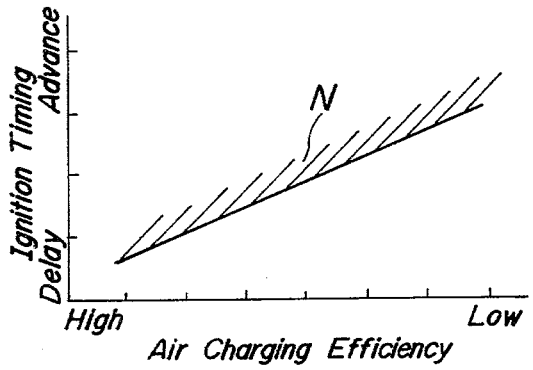
FIG. 3 is a graph illustrating a knocking zone with air charging efficiencies as mentioned above.
Figure 4:
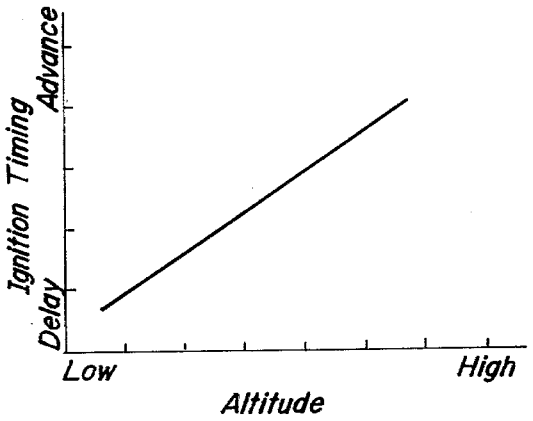
FIG. 4 is a graph showing a required ignition timing characteristic with altitudes (atmospheric pressure) as mentioned above.
Figure 5:
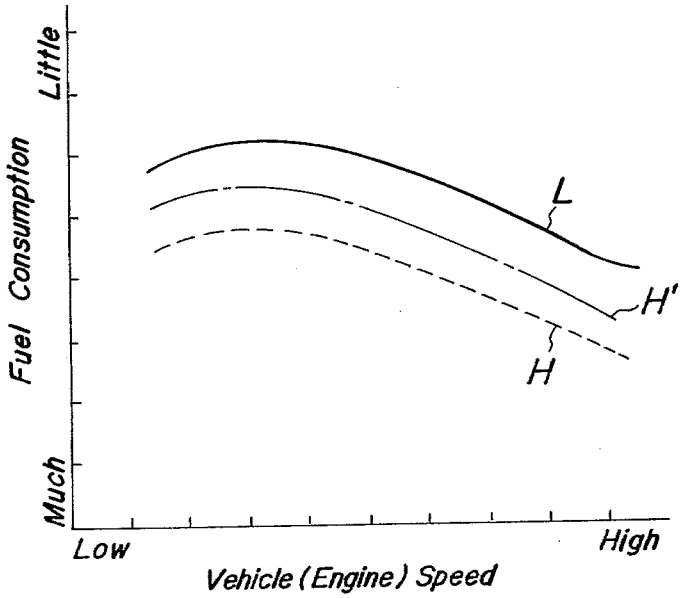
FIG. 5 is a graph of various fuel consumptions with vehicle speeds (engine revolutions) as mentioned above.
Figure 6:
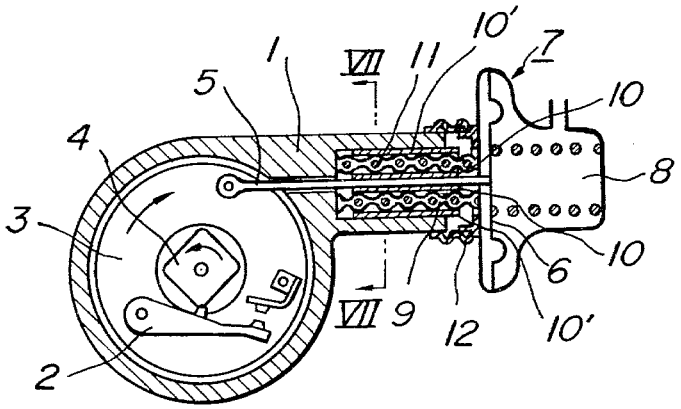
FIG. 6 is a sectional view of one embodiment of the invention.
Figure 7:
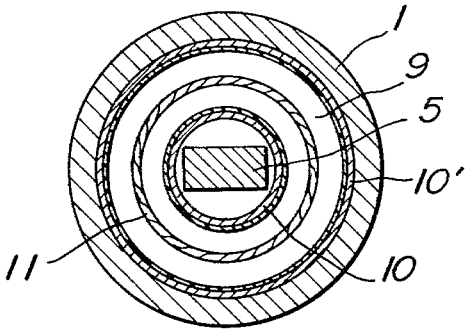
FIG. 7 is a sectional view taken along lines VII—VII in FIG. 6.

Referring to FIGS. 6 and 7, within a distributor body 1 fixed to an engine body (not shown) is arranged in a conventional manner a plate 3 having a contact point 2 and rotatable in a rotating direction of a rotor (cam) 4. A vacuum advance device 7 comprises a diaphragm 6 connected to the plate 3 through a rod 5 and includes a negative pressure chamber 8 to which are supplied negative pressure signals responsive to loads of the engine, for example, negative pressures in the proximity of an intake throttle valve, thereby controlling the plate 3 to be rotated depending upon loads acting upon the engine to control advances of the ignition timing in the conventional manner.

As can be seen from FIG. 6, the vacuum advance device 7 and distributor body 1 are connected so as to be movable toward and away from each other through a bellows 9 as pressure sensitive compensation means in moving direction of the rod 5. The bellows 9 has an annular cross-section covering the rod 5, whose one end is fixed to the distributor body and whose other end is fixed to the vacuum advance device 7. On inner and outer circumferential surfaces are fitted inner and outer sleeves 10 and 10', so that the bellows is elongated or contracted in response to the variation in the atmospheric pressure only in the moving (longitudinal) direction of the rod 5. Any type of bellows may be used so long as their volumes change depending upon variations in the atmospheric pressure. A vacuum body having enclosed therein a coil spring 11 or a body including therein a stable or inert gas such as nitrogen, helium or the like may be used for this purpose. The coil spring 11 or the inert gas helps the bellows to expand when the atmospheric pressure is reduced. A rubber boot 12 is provided between the distributor body 1 and diaphragm 6.

With this arrangement, when the atmospheric pressure becomes lower at a higher altitude, the bellows expands. The bellows is however radially restrained at its inner and outer circumferential surfaces by the sleeves 10 and 10', so that it longitudinally expands or elongates to move the vacuum advance device 7 to the right as viewed in FIG. 6. As a result, the diaphragm 6 of the vacuum advance device 7 is moved to the right beyond the position corresponding to an engine load to rotate the plate 3 through the rod 5 in the clockwise direction, so that the contact point 2 is advanced relative to the rotor 4 rotating in the counterclockwise direction to advance the ignition timing.

On the other hand, when the atmospheric pressure becomes higher at a lower altitude, the bellows contracts or longitudinally shortens to move the vacuum advance device 7 to the left as viewed in FIG. 6, so that the plate 3 is rotated in the counterclockwise direction the same as that of the rotor 4 to delay the ignition timing. It is understood that such a compensation of the ignition timing is also of course effected in response to variations in atmospheric pressure as well as variations in altitude.

In the above embodiment, although the altitude compensation device is constructed in a simple manner by associating the bellows 9 with the inner mechanism of the distributor by means of the vacuum advance device 7, it is clear for those skilled in the art that other constructions may be employed for compensating the ignition timing depending upon the altitude or atmospheric pressure, for example, the plate 3 may be rotatively controlled against the operative force of a vacuum advance device for advancing the ignition timing.

As can be seen from the above explanation, the device according to the invention is able to automatically advance and compensate the ignition timing depending upon variations in altitude (atmospheric pressure) at higher altitudes where knocking occurs owing to the reduced air charging efficiency, thereby preventing the reduction of output and increase of the fuel consumption and pollutant exhaust gases at higher altitudes which would otherwise occur in the prior art and thereby eliminating the requirement of readjustment of the ignition timing responsive to a circumstance (altitude) where an engine is used.

It is further understood by those skilled in the art that the foregoing description is of preferred embodiments of the disclosed device and that various changes and modifications may be made in the invention without departing from the spirit and scope thereof.

What is claimed is:

1. An altitude compensation ignition system for an internal combustion engine having a distributor body, comprising: a vacuum advance device for advancing ignition timing in response to intake negative pressures of the engine, and pressure sensitive compensation means having a bellows elongating and shortening in response to variation in atmospheric pressure to advance ignition timing depending upon lowering of the atmospheric pressure, said bellows forming an annular elongated cylinder whose ends are fixed to said distributor body and said vacuum advance device respectively, and inner and outer sleeves respectively restraining the inner and outer circumferential surfaces of said bellows so that the same moves in axial direction thereof only.

* * * * *